US011165200B2

(12) United States Patent
Weiss et al.

(10) Patent No.: US 11,165,200 B2
(45) Date of Patent: Nov. 2, 2021

(54) ELECTRICAL PLUG CONNECTOR WITH CLOSING AID

(71) Applicant: HIRSCHMANN AUTOMOTIVE GMBH, Rankweil/Brederis (AT)

(72) Inventors: Marco Weiss, Rankweil (AT); Simon Duenser, Bludenz (AT); Thomas Kleiner, Bludenz (AT)

(73) Assignee: HIRSCHMANN AUTOMOTIVE GMBH, Rankweil/Brederis (AT)

( * ) Notice: Subject to any disclaimer, the term of this patent is extended or adjusted under 35 U.S.C. 154(b) by 0 days.

(21) Appl. No.: 16/634,966

(22) PCT Filed: Sep. 7, 2018

(86) PCT No.: PCT/EP2018/074130
§ 371 (c)(1),
(2) Date: Jan. 29, 2020

(87) PCT Pub. No.: WO2019/057519
PCT Pub. Date: Mar. 28, 2019

(65) Prior Publication Data

US 2020/0244007 A1 Jul. 30, 2020

(30) Foreign Application Priority Data

Sep. 7, 2017 (DE) ..... 102017120667.1

(51) Int. Cl.
*H01R 13/629* (2006.01)
*H01R 13/627* (2006.01)

(52) U.S. Cl.
CPC ... *H01R 13/62955* (2013.01); *H01R 13/6273* (2013.01)

(58) Field of Classification Search
CPC ..... H01R 13/62955; H01R 13/6273
USPC ..... 439/310
See application file for complete search history.

(56) References Cited

U.S. PATENT DOCUMENTS 5,244,400 A * 9/1993 Hatagishi ..... H01R 13/641 439/157
5,921,721 A 7/1999 Ono
5,954,528 A 9/1999 Ono
6,036,510 A 3/2000 Ono
6,217,354 B1 * 4/2001 Fencl ..... H01R 13/62977 439/157
6,254,414 B1 * 7/2001 Sawayanagi ..... H01R 13/62922 439/310

(Continued)

FOREIGN PATENT DOCUMENTS

JP 2011-P17344 * 11/2011 ..... H01R 13/62955
JP 2011233401 B 11/2011

*Primary Examiner* — Peter G Leigh
(74) *Attorney, Agent, or Firm* — Andrew Wilford

(57) ABSTRACT

The invention relates to a plug connection (1) which consists of a plug connector (2) and a mating plug connector (3) that can be plugged together in order to form the plug connection (1), comprising a retraction aid which is arranged on a part of the plug connector (1) and which interacts with another part on the mating plug connector (3). The plug connector (1) and the mating plug connector (3) have a retraction aid, said retraction aid being actuated axially in the plug-in direction automatically when the plug connector and the mating plug connector are plugged together.

9 Claims, 3 Drawing Sheets

(56) References Cited

U.S. PATENT DOCUMENTS

| | | | | |
|---|---|---|---|---|
| 6,319,050 | B1 * | 11/2001 | Miyazaki | H01R 13/62938 439/157 |
| 6,354,852 | B2 * | 3/2002 | Noro | H01R 13/62938 439/157 |
| 6,592,384 | B2 * | 7/2003 | Sawayanagi | H01R 13/5202 439/157 |
| 6,783,380 | B1 * | 8/2004 | Kamath | H01R 13/62905 439/247 |
| 6,887,089 | B2 * | 5/2005 | Nishide | H01R 13/6315 439/157 |
| 7,066,763 | B1 * | 6/2006 | Corwin | H01R 13/62966 439/157 |
| 7,479,022 | B2 * | 1/2009 | Lee | H01R 13/506 439/157 |
| 8,011,938 | B2 | 9/2011 | Martin | |
| 8,133,065 | B2 * | 3/2012 | Horiuchi | H01R 13/62938 439/157 |
| 9,325,111 | B2 * | 4/2016 | Pierik | H01R 13/62966 |
| 2004/0077197 | A1 * | 4/2004 | Nishide | H01R 13/62972 439/157 |

* cited by examiner

ELECTRICAL PLUG CONNECTOR WITH CLOSING AID

CROSS REFERENCE TO RELATED APPLICATIONS

This application is the US-national stage of PCT application PCT/EP2018/074130 filed 7 Sep. 2018 and claiming the priority of German patent application 102017120667.1 itself filed 7 Sep. 2017.

FIELD OF THE INVENTION

The invention relates to a retraction aid of an electric plug connector with movement in the plug-in direction, more precisely a plug connector comprising a male plug part and a female plug part that can be plugged together to form the plug connector, with a retraction aid on one part of the plug connector and interacts with a further part on the female plug part

BACKGROUND OF THE INVENTION

Plug connectors are known comprising a male plug part (also described as a pin strip) and a female plug part (with a housing) that can be plugged together to form the plug connector. Since relatively high forces are often necessary for the plug-in process, retraction aids have already become known. A retraction aid of this type is, for example, a lever on one part of the male plug part and interacts with a further part on the female plug part. A lever of this type can be actuated easily, but it sticks out from the plug connector before the male plug part and the female plug part have been plugged together, such that installation space, which is often not available, is required for this purpose.

OBJECT OF THE INVENTION

The underlying problem of the invention is to improve a retraction aid for a plug connector to the effect that less installation space is required.

SUMMARY OF THE INVENTION

This problem is solved by the male plug part and the female plug part having a retraction aid that is automatically actuated in the plug-in direction, i.e. during plugging together of the male plug part and female plug part. The retraction aid thus acts in the axial plug-in direction of the plug connector, such that it requires next to no installation space and, moreover, is automatically actuated during plugging together of the male plug part and female plug part.

In order to create the retraction aid according to the invention, provision is made for the male plug part to have a guide formation, wherein a retraction lever, which can be actuated during plugging together and that interacts with the guide formation as a retraction aid, is on the female plug part. Owing to the interaction of the retraction lever on the female plug part with the guide formation of the male plug part, the retraction aid is actuated during axial actuation of the female plug part in the direction of the male plug part (or vice versa). Owing to the lever action of the retraction lever, low forces are sufficient during plugging together in order to support the plugging-together process by means of the retraction aid. This is particularly advantageous if the male plug part and the associated female plug part have a large number of contact partners that are to be connected to one another. Furthermore, it is not necessary in this case to optimize the frictional engagement between the male plug part and female plug part, since the frictional forces only play a subordinate role during the actuation of the retraction aid, owing to the enlargement of the lever. The female plug part is formed by an inner housing and an outer housing that can be axially displaced relative thereto. The actuation of the retraction aid is carried out by the axial displacement process of the outer housing relative to the inner housing. Further levers or the like that, in the prior art, are arranged outside of the female plug part as a retraction aid may be omitted, so that an axial retraction aid is created by constructing the female plug part in a concentric manner, which substantially saves installation space.

In a development of the invention, provision is made for the guide formation to have two parallel bars that form a guide groove. The retraction lever, in particular a pin arranged on its end, can be inserted into the groove guide and be guided in a targeted manner during plugging-together process. The lever action of the retraction lever can be influenced in a targeted manner by means of the guide formation and the course of the guide groove that is formed by the two parallel bars.

A targeted influencing of the lever action of the retraction lever is carried out in a further configuration of the invention by the two bars having a crossbar that connects the two bars at their one end region. By way of the crossbar, an end stop is thus created for the movement of the retraction lever, in particular its pin that runs in the guide groove. A stop is thus provided for the movement of the retraction aid.

Moreover, a targeted influencing of the lever action of the retraction lever is achieved during the actuation of the retraction aid in a development of the invention by the two parallel bars having an angular deflection along their course. The first part of the course of the bars in their insertion region for the retraction lever causes the part of the retraction aid on the female plug part to be received. The further course of the bars then causes a targeted deflection of the retraction lever, together with the angular deflection in the guide groove, in order to thus bring about the lever action of the retraction lever that is rotatably mounted on the female plug part. Depending on the configuration and motion sequence of the retraction aid, provision can also be made for more than one angular deflection. Instead of at least one angular deflection, it is also conceivable to create is the bars on the male plug part in such a way as to produce a corner for the guide groove.

In order to achieve the lever action of the retraction aid during plugging-together, a further configuration of the invention makes provision for the retraction lever to be arranged on the female plug part, in particular the inner housing thereof, via a pivot, and to have a pin at each of its ends. The lever action is thus achieved by the arrangement of the retraction lever on the female plug part via a pivot. The two pins arranged on its end produce the operative connection, on the one hand, to the female plug part and, on the other hand, to the male plug part.

BRIEF DESCRIPTION OF THE DRAWING

Further configurations and details relating to the retraction aid according to the invention are specified in the subclaims, in which corresponding advantages for creating the retraction aid and its actuation in a constructive manner are set forth. These further configurations are also explained in greater detail in the context of the description of the figures. A retraction aid according to the invention is shown in the attached drawing in which:

SPECIFIC DESCRIPTION OF THE INVENTION

Figure 1:
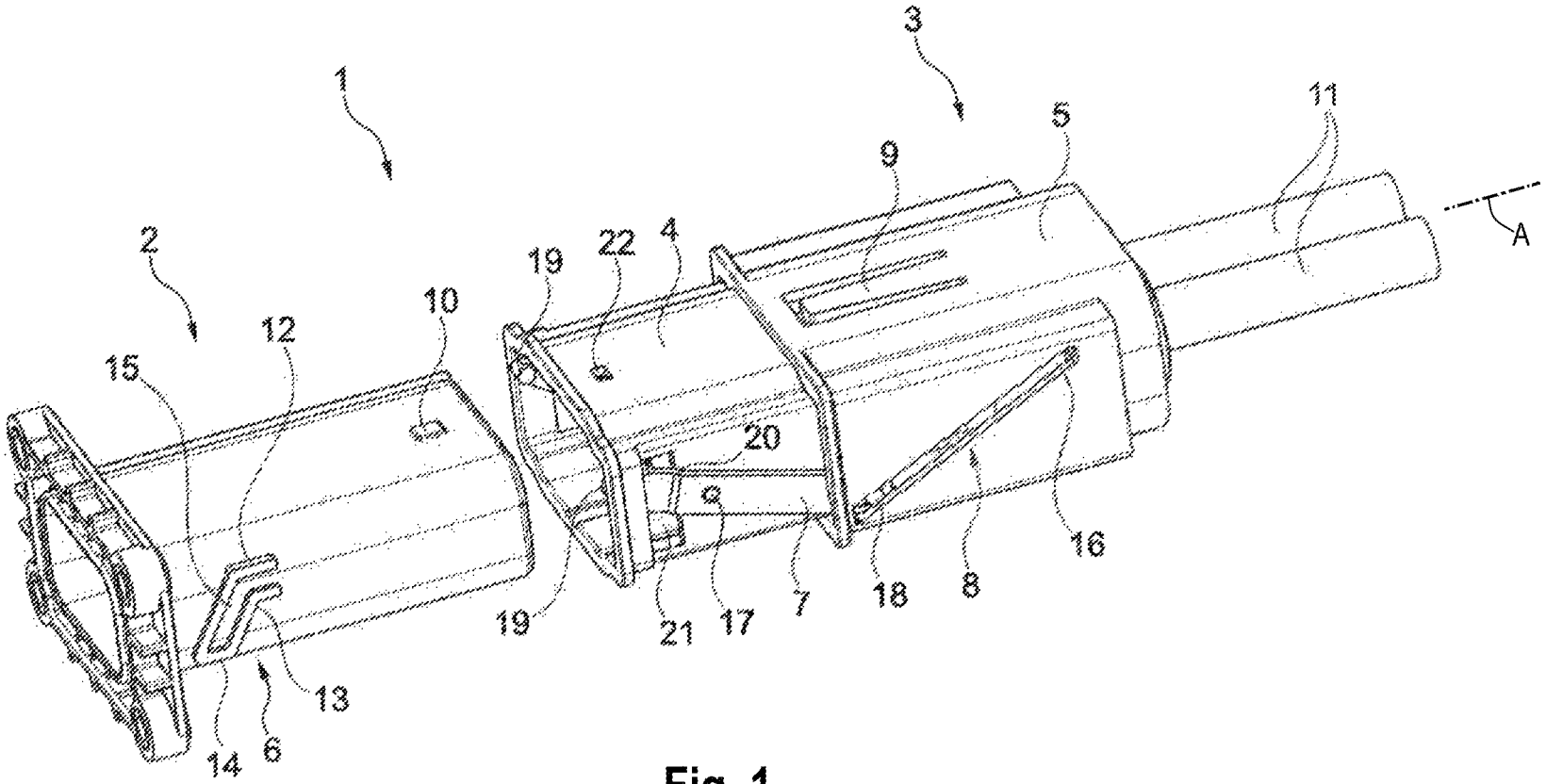
FIG. 1 is an exploded view of the inventive connector in the pre-plug-in position.

FIG. 1 shows a plug connector 1 formed of a male plug part 2 (pin strip) and a female plug part 3 (with housing) that are not yet plugged together. It can be seen that a retraction aid and a latch are present on the male plug part 1. The latter interacts with the retraction aid, which can be displaced in a plug-in direction parallel to an axis A on the housing and a latch that interacts therewith.

As can also be seen in FIG. 1, the female plug part 3 is formed by an inner housing 4 and an outer housing 5. These two housings 4 and 5 are concentrically mounted one inside the other and can be axially displaced relative to one another. A retractor 6 on the male plug part 2 interacts with a retraction lever 7 on the female plug part 3, in particular the inner housing 4 thereof. Furthermore, the female plug part 3, in particular the outer housing 5 thereof, has an elongated guide formation 8 that interacts with the retraction lever 7.

In order to create the retraction aid according to the invention, the female plug part 3, in particular the outer housing 5 thereof, can, but does not have to, have a latching hook 9, and the male plug part 2 a projection 10.

It can be very easily seen in FIG. 1 that the male plug part 2 has not yet been plugged into the female plug part 3. The inner housing 4 and the outer housing 5 are in their pulled-out position, from which it is possible to displace the outer housing 5 to the left in the direction of the inner housing 4 (when viewing FIG. 1), such that the inner housing 4 fits almost completely into the outer housing 5.

Figure 2:
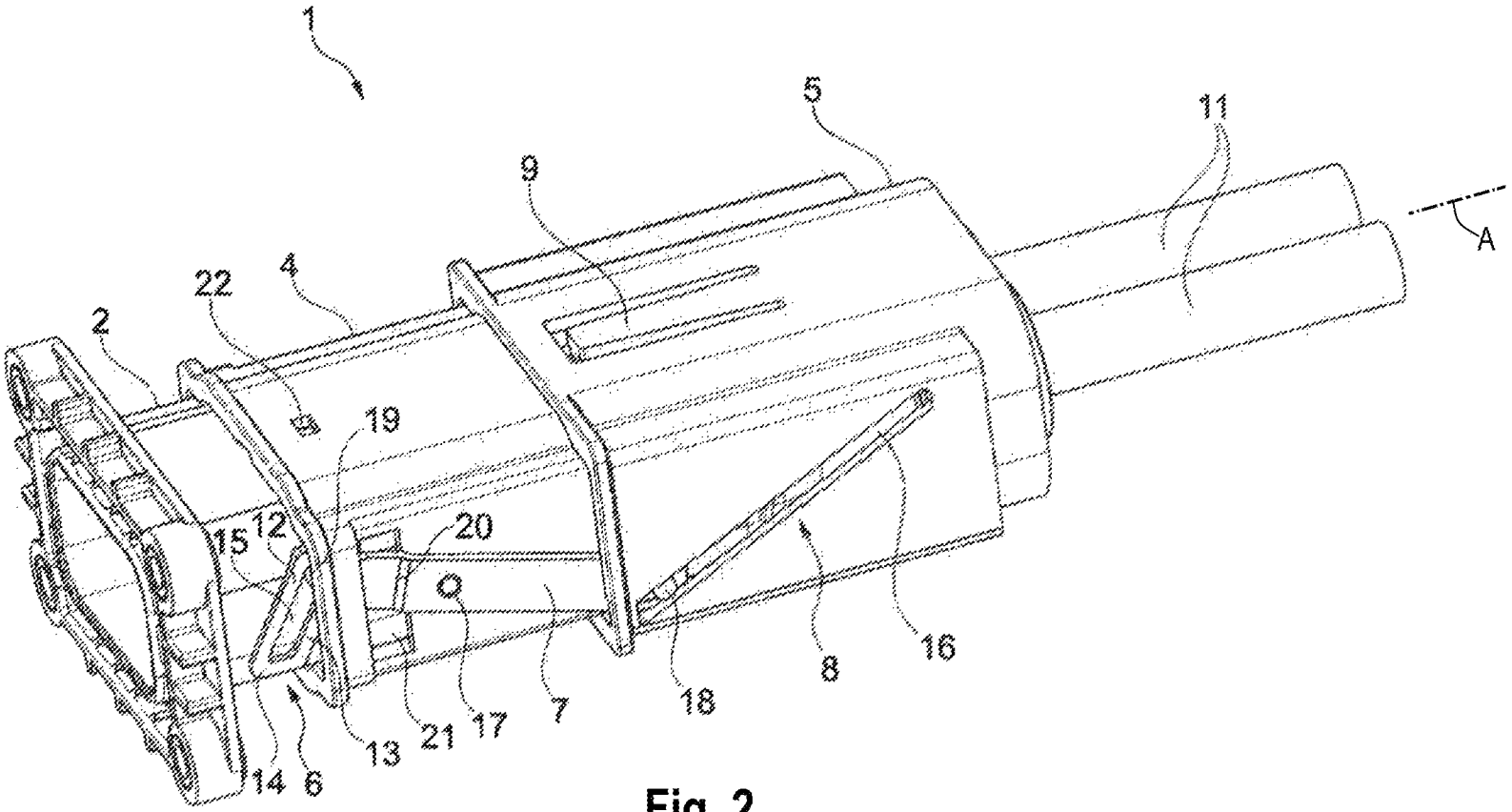
FIG. 2 shows the connector when partially assembled.

FIG. 2 shows a pre-plug-in position in which the female plug part 3 has been inserted a little way into the male plug part 2. The retraction aid of the housing can only be displaced in the plug-in direction once the pre-plug-in position has been reached. In this respect, the latching hook 9 is released at this position by the pin strip (male plug part 2). This latching hook 9, which interacts with the projection 10 of the male plug part 2, can be present, but does not have to be.

Figure 3:
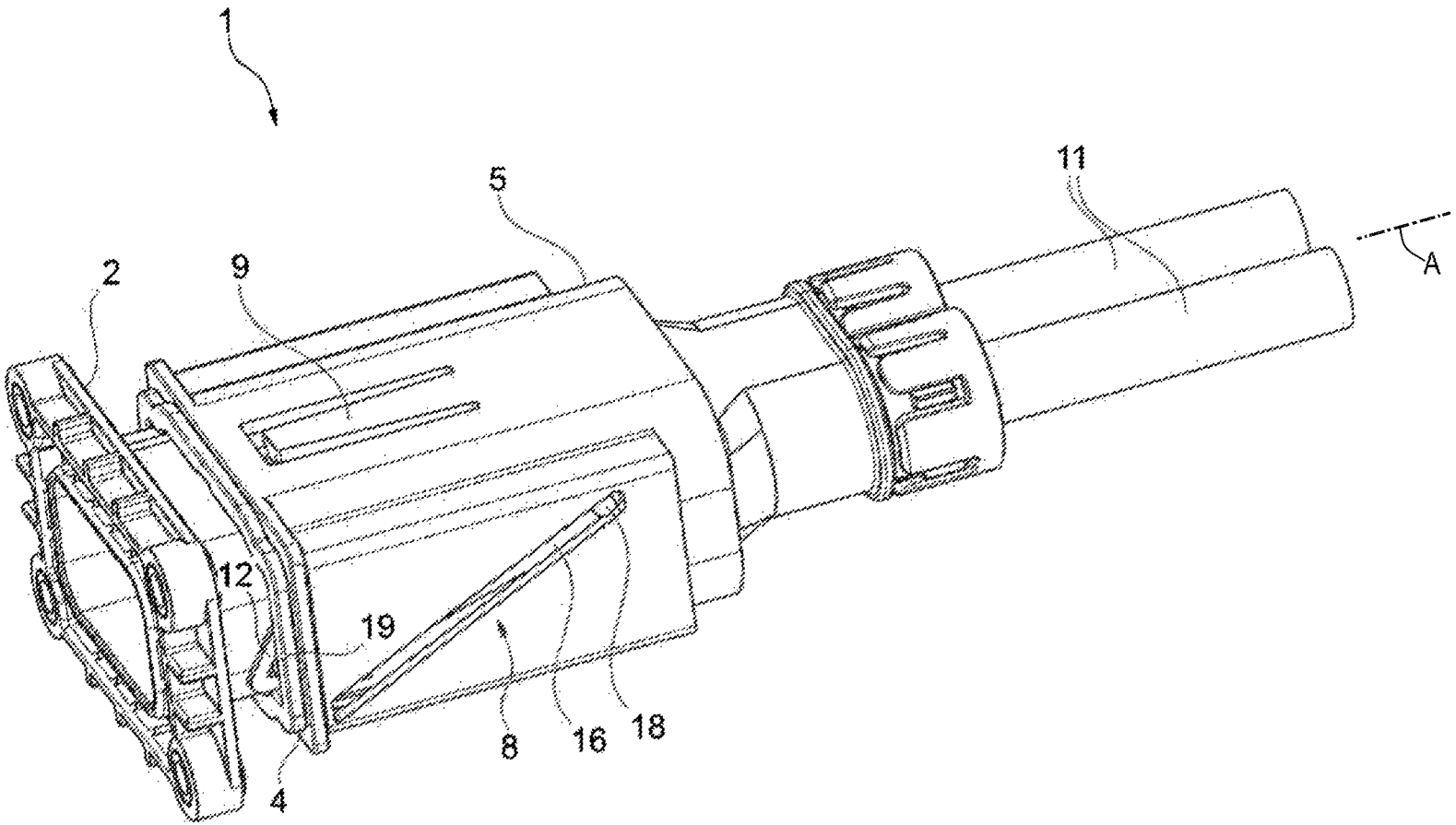
FIG. 3 shows the connector in the fully plugged-in position.

FIG. 3 shows the final plugged-together plug connector 1 (final plug-in position). Once the final plug-in position is reached, the retraction aid of the housing is latched in the inner housing 4 by the latching hook 9. The elongated retraction aid with the associated latching element is inserted into the retraction aid, guided there and then, when the final plug-in position is reached, fixed in the latch.

The entire process of plugging together the male plug part 2 and the female plug part 3 and the manner of operation of the retraction aid and the elements involved are described in even greater detail hereinafter in the context of FIGS. 2 and 3.

The process described above is of course reversible when unplugging.

FIGS. 3 to 5 show the involved components of the plug connector 1 and the motion sequence in detail once again.

It can be seen in FIG. 3 that the guide formation 6 is formed by two parallel bars 12, 13 that have a crossbar 14 at their one end, which crossbar forms a stop. Opposite this end, the guide formation 6 is open so that an element of the retraction aid on the female plug part 3 can be inserted into a guide groove 15 that is formed by the two bars 12, 13, and is guided in a targeted manner during plugging-together process.

The female plug part 3 has an elongated guide groove 16 for the retraction aid, which guide groove is arranged in the outer housing 5 in this embodiment. The retraction lever 7 is included on the side of the female plug part 3 as further elements of the retraction aid, which retraction lever is rotatably mounted on the female plug part 3, in particular the inner housing 4 thereof, about a pivot 17. The retraction aid 7 has a pin 18, 19 on both its ends respectively. In a particular embodiment of this retraction aid, the retraction lever 7 has an angular deflection 20 on its axial course, which angular deflection is guided through a recess 21 of the female plug part 3, in particular the inner housing 4 thereof.

The projection 10 on the male plug part 2 and the latching hook 9 (in particular on the outer housing 5) and an indentation 22, in particular on the inner housing 4, can, but do not have to, play a role in supporting the plugging-together process with the retraction aid according to the invention.

FIG. 3 shows, similarly to FIG. 1, that the individual elements of the plug connector 1 are prepared for the plugging-together process. In this case, the male plug part 2 is not yet plugged into the female plug part 3. The inner housing 4 and the outer housing 5 of the female plug part 3 are pulled apart so that the outer housing 5 is fixed in position on the inner housing 4, but it is possible for the outer housing 5 to be further axially pushed together relative to the inner housing 4. This means that during this pushing together the inner housing 4 plunges almost completely into the outer housing 5 of the female plug part 3 in a concentric manner.

If the latching hook 9 is present, this plunging is still prevented, since an inward-facing free end of the latching hook 9 that engages in a non-identifiable recess in the surface of the inner housing 4, for example, or that rests on a front end of the inner housing 4, still prevents this pushing together. The pushing together is only made possible when the male plug part 2 is inserted into the inner housing 4 and the projection 10 on the male plug part 2 actuates the latching hook 9, more precisely the inward-facing end thereof. In the depiction in FIG. 3 (just as in the depiction in FIG. 1), this state has not yet been achieved.

FIG. 4 shows, similarly to FIG. 2, the so-called pre-plug-in position. In this respect, the male plug part 2 has been plugged a little way into the inner housing 4, for which purpose an elongated axial recess (in the form of a groove) is present on the inner side of the inner housing 4, which recess makes it possible for the projection 10 not to impede the male plug part 2 from plunging into the inner housing 4. The pin 19 of the retraction lever 7 enters into the free region of the guide formation 6 when the pre-plug-in position in accordance with FIG. 4 (or in accordance with FIG. 2) is reached. At the same time, the other pin 18 of the retraction lever 7 is located in the one end region of the slot 16 of the guide formation 8 of the female plug is part 3, in particular the outer housing 5 thereof.

Starting from this pre-plug-in position, the outer housing 5 of the female plug part 3 is axially displaced over the inner housing 4 by manual actuation, such that the retraction aid is actuated by means of the retraction lever 7 and the corresponding interaction of its pins 18, 19 with the retractor 6, on the one hand, and, on the other hand, with the guide formation 8. If the outer housing 5 is pushed further over the inner housing 4 (which means that the inner housing 4 plunges into the outer housing 5) by manual actuation from the outside, the pin 18 of the retraction lever 7 slides along the elongated, obliquely arranged recess 16 in the outer housing 5. Owing to the rotation of the retraction lever 7 about the pivot 17, the pin 19 of the retraction lever 7 is inserted further into the guide formation 6 into the guide groove 15, where the angular deflection (or alternatively a curved configuration) causes the male plug part 2 to be retracted (plunged) further into the inner housing 4 of the female plug part 3 without a further force on the male plug part 2 being necessary for this retraction process. When this process is finished, the final plug-in position that is shown in FIG. 5 (similar to the one in FIG. 2) has been reached. In this final plug-in position, the male plug part 2 is in its intended required position inside the female plug part 3. This means that the plug connector 1 is completely plugged together. In this final plug-in position, owing to the inner housing 4 and the outer housing 5 being pushed together, the retraction lever 7 has been swiveled about its pivot 17, and the pin 18 has come to rest on the other end of the slot 16 is in the outer housing 5, just as the further pin 19 of the retraction lever 7 has reached the end region of the guide groove 15 in the region of the crossbar 14 that forms a stop.

By way of the inner housing 4 plunging into the outer housing 5, owing to a manual actuation on the outside, the retraction lever 7 is thus swiveled about its pivot 17, whereby at the same time the pin 18 moves from its one end position into the other end position in the slot 16 in the outer housing 5, and also at the same time the further pin 19 in the guide groove 15 of the guide formation 6 moves from its insertion region into the end region.

Starting from the pre-plug-in position in accordance with FIG. 4, the free end of the latching hook 9 is elevated by the projection 10 of the male plug part 2, so that it becomes possible for the male plug part 2 to be able to initially plunge a little further into the inner housing 4, such that the pin 19 can plunge into the straight insertion region of the guide formation 6, which insertion region runs parallel to the longitudinal axis of the male plug part 2. As long as this is the case, the retraction aid still has no effect. Starting from this pre-plug-in position, the retraction aid is only actuated once the outer housing 5 is subsequently pushed over the inner housing 4 by manual actuation from the outside. If the final plug-in position shown in FIG. 5 is reached, the free end of the latching hook 9 that has been previously elevated by the projection 10 of the male plug part 2, plunges into an indentation 22 on the upper side of the inner housing 4. The position of the outer housing 5 on the inner housing 4 is secured in this final plug-in position by this latching connection. However, it can be pulled apart again from the outside after the latching hook 9 has been elevated. In this case, the procedures for plugging together that have been described previously are carried out in reverse order.

The invention claimed is:

1. A plug connection comprising:

a male plug part formed with a guide groove;

a female plug part that can be plugged in an axial direction with the mail plug part to form the plug connection and that is comprised of an outer housing and an inner housing axially slidable therein; and a retraction aid on the male plug part, engageable with the female plug part, and having a retraction lever that is carried on the inner housing, engageable with the groove, and automatically axially actuated in the direction during plugging together of the male plug part and female plug part.

2. The plug connection as claimed in claim 1, wherein the male part has two parallel bars that form the guide groove.

3. The plug connection as claimed in claim 2, wherein the two bars have a crossbar that connects the two bars at one end region.

4. The plug connection as claimed in claim 2, wherein the two parallel bars have at least one angular deflection and/or a corner along their course.

5. The plug connection as claimed in claim 1, wherein the retraction lever is carried on the inner housing via a pivot, and has a pin at each of its ends.

6. The plug connection as claimed in claim 5, wherein the female plug part has a slot that interacts with the a pin of the retraction lever.

7. The plug connection as claimed in claim 5, wherein the retraction lever has an angular deflection with which the retraction lever is guided through a recess in the inner housing of the female plug part.

8. The plug connection as claimed in claim 1, wherein the male plug part has a projection on its upper side, and the female plug part has a latching hook that interacts with the projection during plugging together.

9. The plug connection as claimed in claim 8, wherein the female plug part has on its upper side an indentation that interacts with the latching hook during plugging together.

* * * * *